US007623122B2

(12) United States Patent
Fujita

(10) Patent No.: US 7,623,122 B2
(45) Date of Patent: Nov. 24, 2009

(54) ELECTRO-OPTICAL DEVICE AND ELECTRONIC APPARATUS

(75) Inventor: Shin Fujita, Suwa (JP)

(73) Assignee: Seiko Epson Corporation (JP)

( * ) Notice: Subject to any disclaimer, the term of this patent is extended or adjusted under 35 U.S.C. 154(b) by 716 days.

(21) Appl. No.: 11/301,749

(22) Filed: Dec. 13, 2005

(65) Prior Publication Data

US 2006/0139288 A1 Jun. 29, 2006

(30) Foreign Application Priority Data

Dec. 14, 2004 (JP) ..... 2004-361002

(51) Int. Cl.
*G09G 5/00* (2006.01)

(52) U.S. Cl. ..... 345/204; 345/55; 345/87

(58) Field of Classification Search ..... 345/204, 345/206, 55, 87

See application file for complete search history.

(56) References Cited

U.S. PATENT DOCUMENTS 6,670,943 B1 12/2003 Ishii et al.
7,224,341 B2 5/2007 Ishii et al.
2007/0064511 A1 * 3/2007 Shionoiri et al. ..... 365/203

FOREIGN PATENT DOCUMENTS

| | | |
|---|---|---|
| JP | 04-311175 | * 11/1992 |
| JP | 10-221676 | 8/1998 |
| JP | 2000-227784 | 8/2000 |
| JP | 2001-166744 | 6/2001 |

* cited by examiner

*Primary Examiner*—Richard Hjerpe
*Assistant Examiner*—Leonid Shapiro
(74) *Attorney, Agent, or Firm*—Harness, Dickey & Pierce, P.L.C.

(57) ABSTRACT

An electra-optical device includes an electra-optical panel having scanning lines, data lines, and pixels corresponding to intersections of the scanning lines and the data lines. First and second scanning line driving circuits output scanning signals to odd-numbered scanning lines and even-numbered scanning lines, respectively. A pixel forming region is located between the first and second scanning line driving circuits. Each of the first and second scanning line driving circuits includes a shift register unit, an output control circuit, and an output buffer unit. The shift register unit sequentially shifts a start pulse based on a clock signal to produce output signals. The output control circuit generates scanning signals based on logical products of the scanning signals from the other of the first and second scanning line driving circuits and the output signals. The output buffer unit outputs the scanning signals to the scanning lines.

10 Claims, 8 Drawing Sheets

ELECTRO-OPTICAL DEVICE AND ELECTRONIC APPARATUS

The entire disclosure of Japanese Application No. 2004-361002, filed Dec. 14, 2004 is expressly incorporated by reference herein.

BACKGROUND

1. Technical Field

The present invention relates to an electro-optical device and an electronic apparatus.

2. Related Art

In general, in electro-optical devices, such as liquid crystal devices and organic EL devices, a plurality of data lines and a plurality of scanning lines are formed in an image region, and thin film transistors (hereinafter, referred to as TFTs) are provided in pixel electrodes which are arranged in a matrix corresponding to intersections of the scanning lines and the data lines. The liquid crystal device includes, as driving circuits, a data line driving circuit and a scanning line driving circuit that supply data signals and scanning signals to the data lines and scanning lines, respectively, at a predetermined timing.

The scanning line driving circuit generates selection signals by the following method and then generates scanning signals on the basis of the selection signals. First, the scanning line driving circuit sequentially transmits a start pulse according to a clock signal and an inversion clock signal obtained by inverting the clock signal to generate a plurality of shift pulses whose phases deviate from the clock signal by half the period thereof. Second, the scanning line driving circuit calculates the logical product of a shift pulse and the next shift pulse to generate the scanning signals.

In recent years, the resolution and precision of liquid crystal display devices have been advanced, and thus a scanning period has become short. As a result, data signals are insufficiently written, which causes the desired image not to be displayed. Therefore, it is preferable to increase the scanning period to as long as possible. However, when the scanning period is elongated, a plurality of scanning lines adjacent to each other, for example, the selected scanning line in the current stage and the scanning line in the next stage, may be selected at the same time, and images overlap each other in the column direction, which results in a so-called longitudinal ghost image (cross-talk).

Therefore, an electro-optical device has been proposed in which a cross-talk prevention circuit using inversion delay by an inverter is provided in a scanning line driving circuit (for example, see JP-A-2001-166744).

However, the electro-optical device disclosed in JP-A-2001-166744 has a problem in that a plurality of adjacent scanning lines may be selected at the same time due to a variation in the ON current of transistors constituting the inverter.

SUMMARY

An advantage of some aspects of the invention is that it provides an electro-optical device capable of reliably preventing a plurality of scanning lines from being selected at the same time and an electronic apparatus including the electro-optical device.

According to an aspect of the invention, an electro-optical device includes an electro-optical panel that includes a plurality of scanning lines, a plurality of data lines, and pixels provided corresponding to intersections of the scanning lines and the data lines; a first scanning line driving circuit that outputs first scanning signals to odd-numbered scanning lines of the plurality of scanning lines; and a second scanning line driving circuit that outputs second scanning signals to even-numbered scanning lines of the plurality of scanning lines, the second scanning line driving circuit being opposite to the first scanning line driving circuit with a pixel forming region having the pixels formed therein interposed therebetween. The first scanning line driving circuit includes a first shift register unit that is constituted by cascading a plurality of first shift unit circuits which sequentially shift a start pulse, on the basis of a clock signal, to output first output signals; a first output control circuit that has a plurality of first calculation unit circuits which are provided corresponding to the first shift unit circuits, the first calculation unit circuits calculating the logical products of the first output signals and the second scanning signals output through the corresponding even-numbered scanning lines from the second scanning line driving circuit to generate the first scanning signals; and a first output buffer unit that is connected to the odd-numbered scanning lines to output the first scanning signals to the corresponding odd-numbered scanning lines. The second scanning line driving circuit includes a second shift register unit that is constituted by cascading a plurality of second shift unit circuits which sequentially shift the start pulse, on the basis of the clock signal, to output second output signals; a second output control circuit that has a plurality of second calculation unit circuits which are provided corresponding to the second shift unit circuits, the second calculation unit circuits calculating the logical products of the second output signals and the first scanning signals output through the corresponding odd-numbered scanning lines from the first scanning line driving circuit to generate the second scanning signals; and a second output buffer unit that is connected to the even-numbered scanning lines to output the second scanning signals to the corresponding even-numbered scanning lines.

According to this structure, when, for example, a first scanning line (that is, an odd-numbered scanning line) of the plurality of scanning lines provided at the uppermost side of the electro-optical panel is selected and thus a first scanning signal is output, the pixel close to the first output buffer unit immediately turns to an on state since it has a small wiring line length. In contrast, the pixel formed apart from the first output buffer unit (for example, the pixel positioned at an end portion of the scanning line) has a large time constant by the resistance and parasitic capacitance of the scanning line. Thus, the pixel does not immediately turn to an on state, but turns to the on state later than the pixel close to the first output buffer unit. The second scanning signal (that is, the even-numbered scanning line) output to the second scanning line in the next stage is generated by the logical product of the first scanning signal having a large time constant and the second output signal generated by the second shift register unit. That is, the transmission delay of the selected scanning signal in the current stage is used to perform the waveform control of the scanning signal in the next stage. Therefore, the period in which the first scanning signal overlaps the second scanning signal does not exist. As a result, the pixel corresponding to the first scanning line and the pixel corresponding to the second scanning line do not turn to on states at the same time. Thus, since the same data signal is not output to different scanning lines, abnormal display, such as a so-called longitudinal ghost image (or 'cross-talk'), does not occur.

Further, since the scanning line driving circuits are formed on both sides of the pixel forming region, it is possible to reduce the circuit size of each scanning line driving circuit, compared with a case in which the scanning line driving circuit is formed on only one side. In addition, in particular, in an electro-optical device in which a large number of scanning line are used to realize a high-precision electro-optical panel, in order to narrow the wiring pitches between the scanning lines, the scanning lines from the output buffer unit should be formed at narrow pitches. However, since the scanning line driving circuits are formed on both sides of the pixel forming region, the invention makes it possible to widen the wiring pitches between the scanning lines from the output buffer unit. As a result, it is possible to easily design a scanning line driving circuit.

The electro-optical device having the above-mentioned electro-optical panel therein includes, for example, an organic electro-luminescent device having an organic electro-luminescent element in each pixel, a liquid crystal device having liquid crystal elements therein, an electro-optical device using a digital micro mirror device (DMD), a field emission display (FED) using electron emission elements, and a surface-conduction electron-emitter display (SED). In addition, the liquid crystal device includes a scanner used for purposes other than a display device, in addition to a liquid crystal display device for displaying a predetermined image.

Further, in the above-mentioned structure, it is preferable that the first and second calculation unit circuits be composed of NAND circuits and NOR circuits, respectively.

According to this structure, the first and second calculation unit circuits are composed of NAND circuits and NOR circuits, respectively. Therefore, the transmission delay of the scanning signals is controlled by a combination of the NAND circuit and the NOR circuit. As a result, it is possible to easily perform the waveform control of the scanning signals in the next stage.

Furthermore, in the above-mentioned structure, it is preferable that the first output control circuit be provided between the first shift register unit and the first output buffer unit, and that the second output control circuit be provided between the second shift register unit and the second output buffer unit.

According to this structure, it is possible to provide level shifters for controlling the levels of the voltage signals output from the respective shift register units between the output control circuits and the shift register units.

Moreover, in the above-mentioned structure, it is preferable that the electro-optical panel further include resistors provided between the first output control circuit and the first scanning lines and between the second output control circuit and the second scanning lines.

According to this structure, since the resistors are respectively provided between the first output control circuit and the first scanning lines and between the second output control circuit and the second scanning lines, the selected scanning signal in the current stage is delayed. As a result, it is possible to reliably remove the period in which the scanning signal in the current stage overlaps the scanning signal in the next stage.

Further, in the above-mentioned structure, it is preferable that the electro-optical panel further include capacitors provided between the first output control circuit and the first scanning lines and between the second output control circuit and the second scanning lines.

According to this structure, since the capacitors are respectively provided between the first output control circuit and the first scanning lines and between the second output control circuit and the second scanning lines, the selected scanning signal in the current stage is delayed. As a result, it is possible to reliably remove the period in which the scanning signal in the current stage overlaps the scanning signal in the next stage.

Furthermore, according to another aspect of the invention, an electronic apparatus includes the above-described electro-optical device.

According to this structure, since the electro-optical device does not select a plurality of scanning lines at the same time, abnormal display, such as a so-called longitudinal ghost image (or 'cross-talk'), does not occur. As a result, it is possible to obtain an electronic apparatus capable of displaying a high-quality image.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described with reference to the accompanying drawings.

First Embodiment

Figure 1:
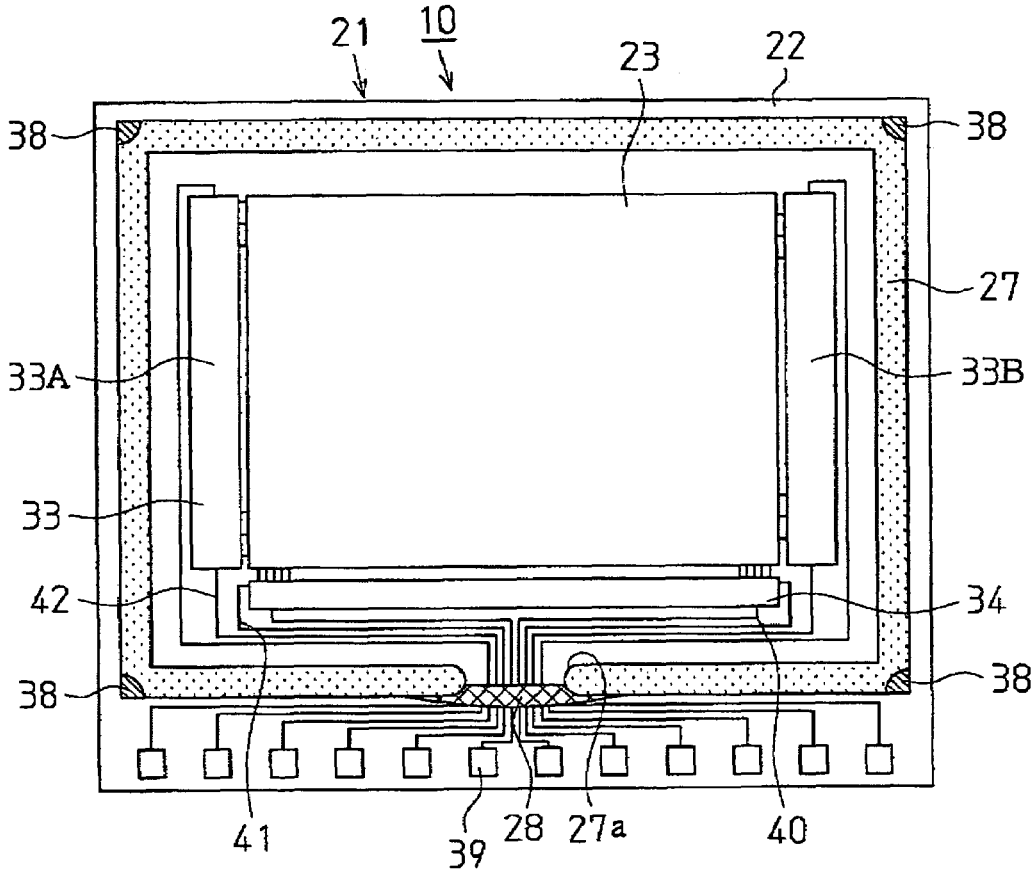
FIG. 1 is a view illustrating an electro-optical panel according to a first embodiment of the invention.
Figure 2:
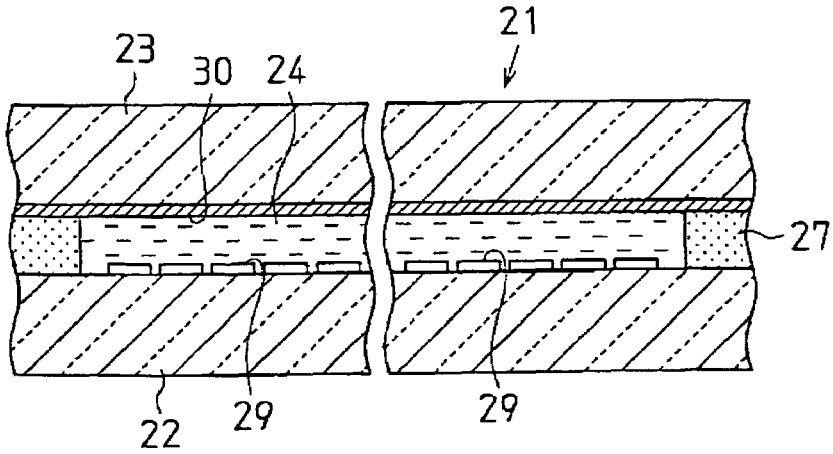
FIG. 2 is a cross-sectional view of the electro-optical panel.
Figure 3:
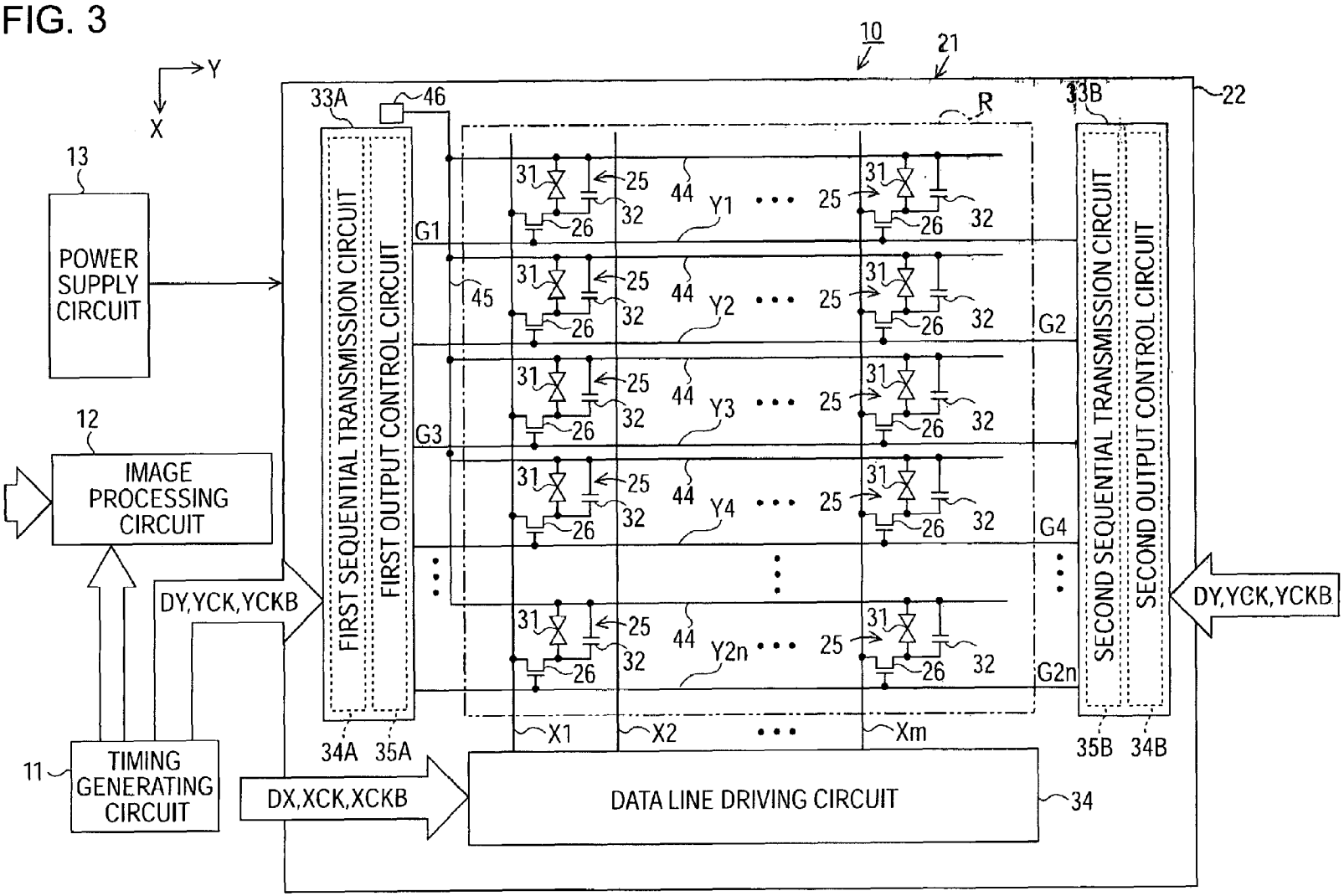
FIG. 3 is a view illustrating the electrical structure of an electro-optical device.
Figure 4:
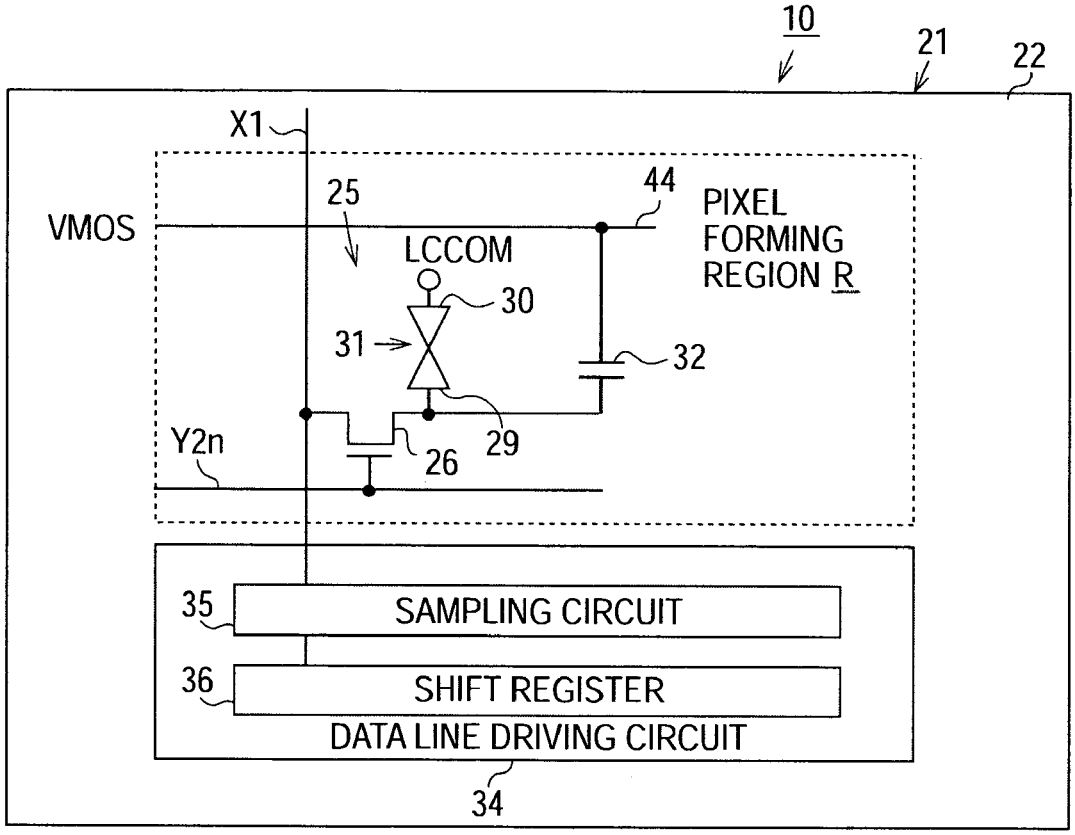
FIG. 4 is a view illustrating the structure of a pixel and the structure of a data line driving circuit.

FIG. 1 is a view illustrating an electro-optical panel with an external circuit removed from an electro-optical device according to a first embodiment of the invention. FIG. 2 is a cross-sectional view illustrating a portion of the electro-optical panel. FIG. 3 is a block diagram schematically illustrating the electrical structure of the electro-optical device. FIG. 4 is a block diagram illustrating the structure of a pixel and a data line driving circuit.

An electro-optical device 10 of this embodiment is an active matrix electro-optical device in which peripheral driving circuits are formed of polycrystalline silicon thin film transistors. In addition, the electro-optical device 10 performs common swing driving in which a potential (common potential VCOM) between a pixel electrode of each pixel and a counter electrode opposite to the pixel electrode with liquid crystal interposed therebetween is inverted between a low potential and a high potential every predetermined period, for example, one horizontal scanning period, so that a positive image signal and a negative image signal are alternately written onto each pixel. In this embodiment, the common swing driving is used, but common DC driving in which the potential between the counter electrode and the pixel electrode is fixed may be used.

The electro-optical device 10 includes an electro-optical panel 21. As shown in FIGS. 1 and 2, the electro-optical panel 21 includes an element substrate 22, a counter substrate 23, and TN (twisted nematic)-type liquid crystal 24 injected between the two substrates. The element substrate 22 and the counter substrate 23 are bonded to each other with a sealing member 27 including spacers (not shown), with a gap between the element substrate 22 and the counter substrate 23 uniformly maintained, and the liquid crystal 24 is injected into the gap between the two substrates. The sealing member 27 is formed at the circumferential edge of the counter substrate 23 and has an opening 27*a* for injecting the liquid crystal 24. The opening 27*a* is sealed by a sealing material 28 after the liquid crystal 24 is injected.

As shown in FIG. 3, the element substrate 22 is provided with 2n scanning lines Y1 to Y2*n* arranged in the Y direction, m data lines X1 to Xm arranged in the X direction, and 2n×m pixels 25 that are arranged in a matrix corresponding to intersections of the scanning lines Y1 to Y2*n* and the data lines X1 to Xm. In addition, in the element substrate 22, a polysilicon thin film transistor (hereinafter, referred to as a TFT) 26, serving as a switching element, is provided in each pixel 25.

As shown in FIG. 4, a gate of each TFT 26 is connected to one of the scanning lines Y1 to Y2*n* (for example, the scanning line 2*n*), and a source thereof is connected to one of the data lines X1 to Xm (for example, the data line X1). In addition, a drain thereof is connected to the pixel electrode 29 of the corresponding pixel 25. An image signal is written onto each pixel 25 through the TFT 26. Further, as shown in FIG. 1, the element substrate 22 is further provided with silver points 38, serving as connecting terminals to the counter substrate 23, input terminals 39 to which various signals are input from an external circuit, X-driver signal lines 40, image signal lines 41, and Y-driver signal lines 42.

As shown in FIGS. 2 and 4, the pixel electrodes 29 of the pixels 25 are opposite to a common electrode 30 provided on the counter substrate 23 as a counter electrode with the liquid crystal 24 interposed therebetween. In addition, each pixel 25 includes a liquid crystal capacitor 31 formed by a rectangular pixel electrode 29, the common electrode 30, and the liquid crystal 24 provided therebetween and a storage capacitor 32 that is connected in parallel to the liquid crystal capacitor 31 to reduce the leakage of liquid crystal capacitance thereof. Therefore, each pixel 25 is composed of the TFT 26, the pixel electrode 29, the common electrode 30, the liquid crystal capacitor 31, and the storage capacitor 32. In the pixel 25, when the TFT 26 is turned on (an electrical connection state), an image signal of a pixel converted into a voltage signal is written onto the liquid crystal capacitor 31 and the storage capacitor 32 through the TFT 26. When the TFT 26 is turned off (a non-electrical-connection state), electric charges are stored in these capacitors.

As shown in FIGS. 1 and 3, the electro-optical device 10 includes a pair of scanning line driving circuits (Y-drivers) 33A and 33B, serving as the peripheral driving circuits formed on the element substrate 22, which drive the scanning lines Y1 to Y2*n* through a pixel forming region R (see FIG. 3). In addition, the electro-optical device 10 includes, at the lower side thereof, a data line driving circuit (X-driver) 34 for driving the data lines X1 to Xm through the pixel forming region R. These driving circuits are formed on the element substrate 22 by using a thin-film-transistor forming technique. Further, the electro-optical device 10 includes a timing generating circuit 11, an image processing circuit 12, and a power supply circuit 13 as external circuits, as shown in FIG. 3.

The timing generating circuit 11 supplies synchronizing signals and clock signals to the scanning line driving circuits (Y-drivers) 33A and 33B and the data line driving circuit 34 to control the operation timing of these circuits. A transmission start pulse DY, serving as the synchronizing signal, a clock signal YCK, and an inversion clock signal YCKB are supplied from the timing generating circuit 11 to the scanning line driving circuits (Y-driver) 33A and 33B.

Further, a transmission start pulse DX, serving as the synchronizing signal, a clock signal XCK, and an inversion clock signal XCKB are supplied from the timing generating circuit 11 to the data line driving circuit 34. In addition, the timing generating circuit 11 controls the operation timing of the image processing circuit 12 in synchronism with the synchronizing signals and the clock signals. The timing generating circuit 11 switches a voltage (common voltage VCOM) applied to a VCOM terminal 46 shown in FIG. 3 between a low potential and a high potential every one horizontal scanning period, in order to perform the common swing driving in synchronism with the synchronizing signal and the clock signals.

The image processing circuit 12 processes input image signals, such as video signals or television signals, to supply the processed image signals to the data line driving circuit 34 at the operation timing controlled by the timing generating circuit 11. In this embodiment, the image signals supplied from the image processing circuit 12 to the data line driving circuit 34 include image data of each pixel. The image data of each pixel is digital gray-scale data representing the brightness of each pixel in an 8-bit binary number, and is a 256-stage gray-scale value of '0' to '255'.

The power supply circuit 13 generates and outputs various power supply voltages.

Each of the scanning line driving circuits 33A and 33B sequentially generates and outputs scanning signals G1 to G2*n* by using the transmission start pulse DY, the clock signal YCK, and the inversion clock signal YCKB supplied at the beginning of a vertical scanning period (at the beginning of one frame), and sequentially selects the scanning lines Y1 to Y2*n*. When the scanning signals G1 to G2*n* are supplied to the sequentially selected scanning lines Y1 to Y2*n*, all TFTs 26 connected to the selected scanning line are turned on. In the invention, 'one horizontal scanning period' means a period in which image signals are written onto the capacitors 31 and 32 of each of the pixels 25 connected to one of the sequentially selected scanning lines Y1 to Y2*n* so that display corresponding to one line is performed. In addition, 'one frame period' means a period in which the image signals are written onto the capacitors (the liquid crystal capacitors 31 and the storage capacitors 32) of all pixels 25 connected to the sequentially selected scanning lines Y1 to Y2*n* so that display corresponding to a screen is performed.

As shown in FIG. 4, the data line driving circuit 34 includes a shift register 36, a sampling circuit 35, and a digital-analog converter (not shown).

The shift register 36 sequentially generates selection signals by using the transmission start pulse DX, the clock signal XCK, and the inversion clock signal XCKB supplied at the beginning of each horizontal scanning period from the timing signal, and then outputs them.

The sampling circuit 35 includes a plurality of switches (not shown) provided on each of the data lines X1 to Xm. For example, each switch serves as a transmission gate which is turned on when an H-level selection signal is input.

In the data line driving circuit 34 having the above-mentioned structure, in each horizontal scanning period, when the H-level selection signal is sequentially input to the switches of first to m-th data lines X1 to Xm, the switches are sequentially opened, so that the image signals are written onto the data lines X1 to Xm and the pixels 25 through the TFTs 26 of the pixels 25.

Next, the first and second scanning line driving circuits 33A and 33B will be described in detail with reference to FIGS. 3, 5, and 6.

As shown in FIG. 3, the scanning line driving circuits 33A and 33B respectively include first and second sequential transmission circuits 34A and 34B that sequentially transmit shift pulses, which will be described later, on the basis of the clock signal YCK and the inversion clock signal YCKB, and first and second output control circuit units 35A and 35B that generate the scanning signals G1 to G2*n* on the basis of the transmitted shift pulses and then output them. In addition, the first sequential transmission circuit 34A of the first scanning line driving circuit 33A is connected to odd-numbered scanning lines Y1, Y3, . . . of 2n scanning lines Y1 to Y2*n*, and the second sequential transmission circuit 34B of the second scanning line driving circuit 33B is connected to even-numbered scanning lines Y2, Y4, . . . Y2*n* of the 2n scanning lines Y1 to Y2*n*. Further, the first and second output control circuit units 35A and 35B are connected to all scanning lines Y1 to Y2*n*.

The first output control circuit unit 35A inputs the scanning signals G2, G4, . . . , G2*n* through the scanning lines Y2, Y4, . . . , Y2*n*. The first output control circuit unit 35A generates odd-numbered scanning signals G1, G3, and the like by using the shift pulse output from the first sequential transmission circuit 34A and the scanning signals G2, G4, . . . , G2*n* from the scanning lines Y2, Y4, . . . , Y2*n* and then sequentially outputs them to the corresponding odd-numbered scanning lines Y1, Y3, and the like. In addition, the second output control circuit unit 35B inputs the scanning signals G1, G3, and the like through the odd-numbered scanning lines Y1, Y3, and the like. The second output control circuit unit 35B generates even-numbered scanning signals G2, G4, and the like by using the shift pulse output from the second sequential transmission circuit 34B and the scanning signals G1, G3, and the like from the scanning lines Y1, Y3, and the like and then sequentially outputs them to the corresponding even-numbered scanning lines Y2, Y4, and the like.

Figure 5:
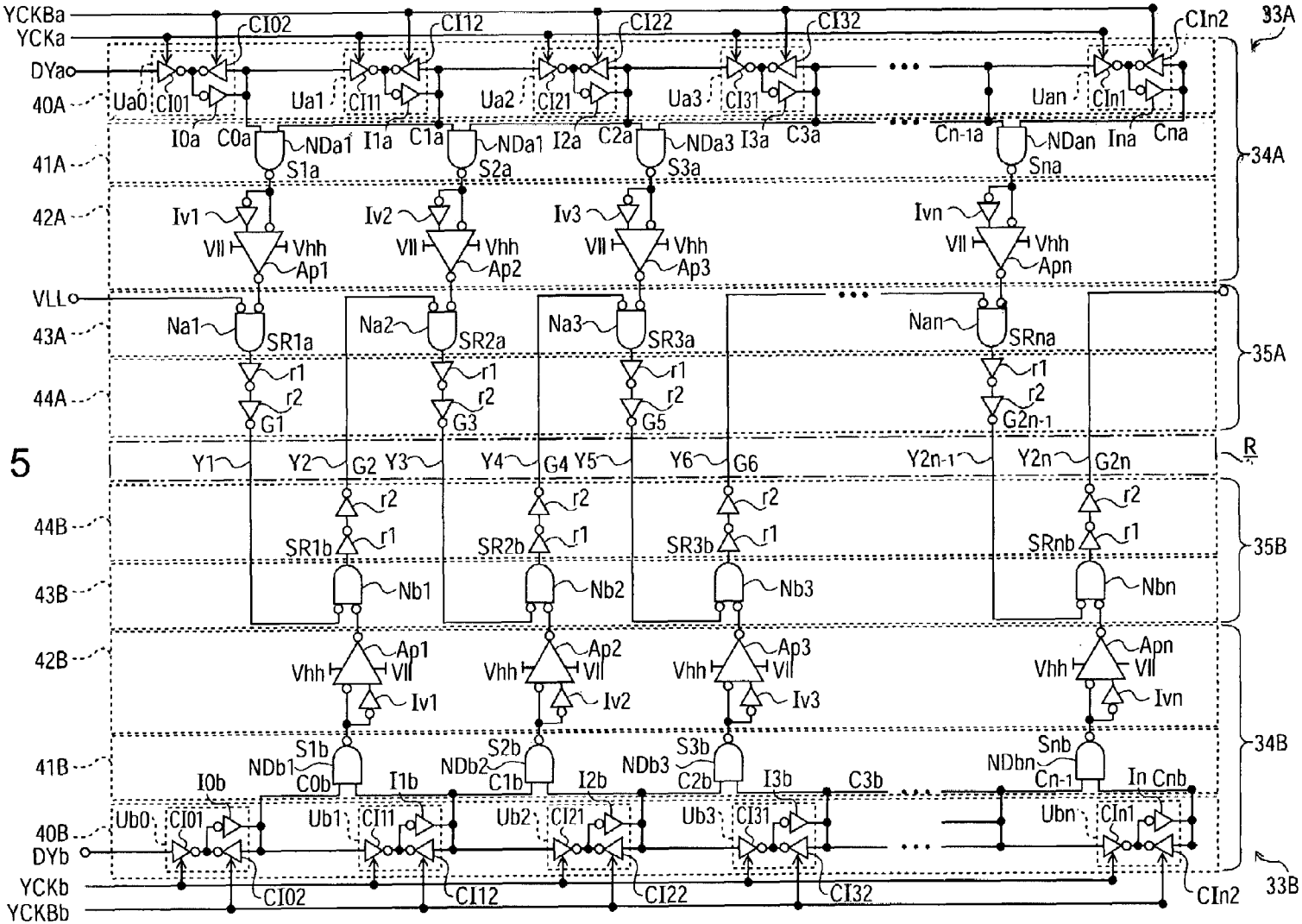
FIG. 5 is a view illustrating a first scanning line driving circuit and a second scanning line driving circuit according to the first embodiment.
Figure 6:
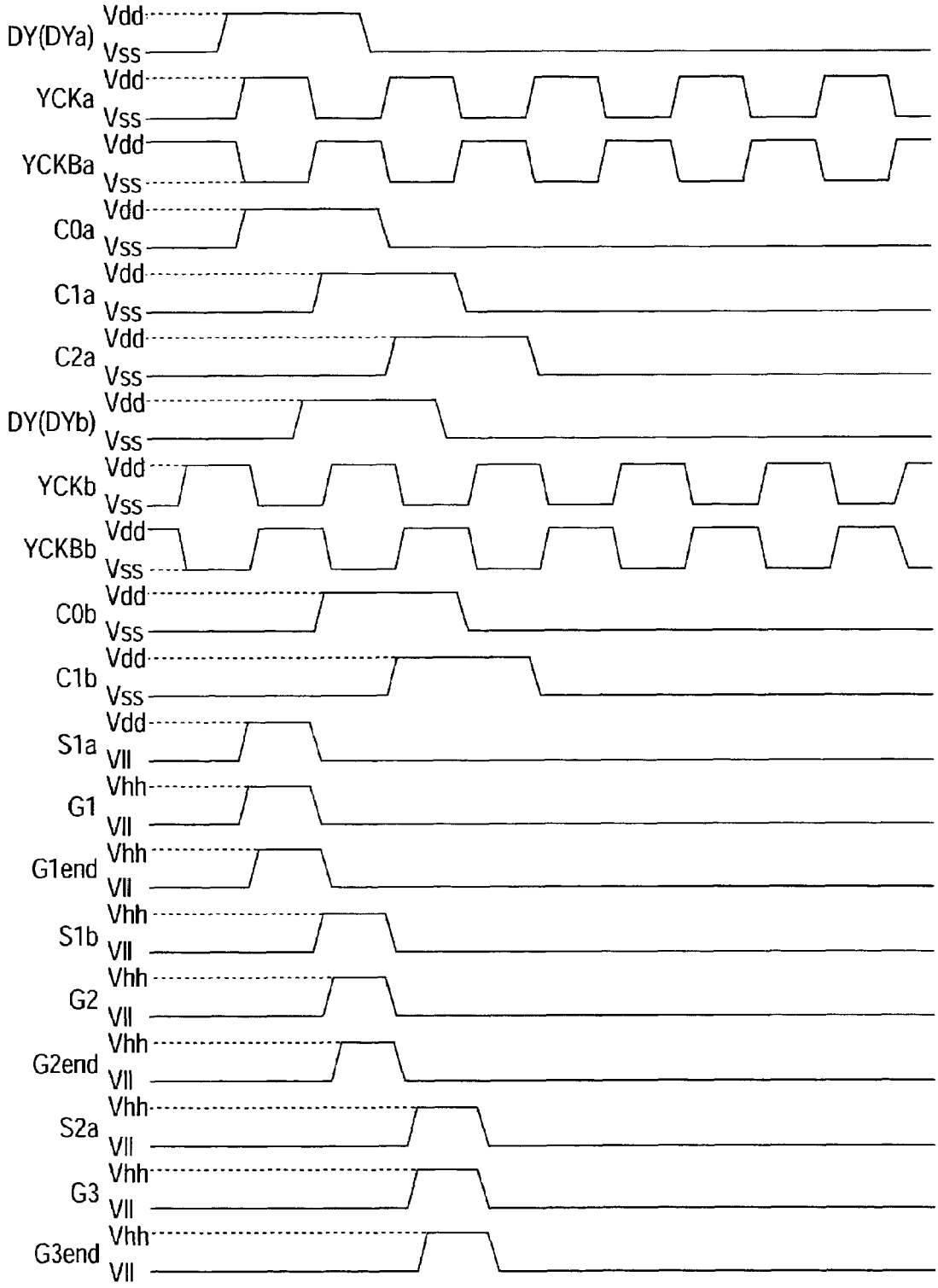
FIG. 6 is a timing chart illustrating the driving of the first and second scanning line driving circuits.

FIG. 5 is a diagram illustrating the first scanning line driving circuit 33A and the second scanning line driving circuit 33B in detail. FIG. 6 is a timing chart illustrating the driving of the first scanning line driving circuit 33A and the second scanning line driving circuit 33B.

As shown in FIG. 5, the first sequential transmission circuit 34A includes a first shift register unit 40A, a first signal generating unit 41A, and a first level shifter 42A. The output control circuit unit 35A includes a first output control circuit 43A and a first output buffer unit 44A.

The first shift register unit 40A is constituted by cascading n+1 shift register unit circuits Ua0 to Uan. The shift register unit circuits Ua0 to Uan each includes two clocked inverters CI01 to CIn1 and CI02 to CIn2 and one inverter I0*a* to Ina. Each of the clocked inverters CI01 to CIn1 and CI02 to CIn2 inverts an input signal and outputs the inverted signal when the voltage of a control terminal is at an H level, and causes an output terminal to be in a high-impedance state when the voltage of the control terminal is at an L level. The inversion clock signal YCKB and the clock signal YCK which are output from the timing generating circuit 11 and are kept in an active state for a predetermined period are supplied to the respective control terminals. In this embodiment, the scanning lines Y1 to Y2*n* are selected in the order of the first scanning line Y1→the second scanning line Y2→the third scanning line Y3→the fourth scanning line Y4→, . . . , →the 2n-th scanning line Y2*n*→the first scanning line Y1, and so on. In contrast, as shown in FIG. 6, the clock signal YCK supplied to the second scanning line driving circuit 33B has a phase delayed from that of the clock signal YCK supplied to the first scanning line driving circuit 33A by half a period. In order to distinguish between them, the clock signal YCK supplied to the first shift register unit 40A is indicated by letters 'YCKa', and the clock signal YCK supplied to the second shift register unit 40B is indicated by letters 'YCKb'.

Further, after the first scanning line driving circuit 33A selects the first scanning line Y1, the second scanning line driving circuit 33B starts selecting the second scanning lines Y2. Therefore, the transmission start pulse DY supplied to the second scanning line driving circuit 33B is delayed in phase from the transmission start pulse DY supplied to the first scanning line driving circuit 33A by the period in which the first scanning line Y1 is selected. In order to distinguish between them, the transmission start pulse DY supplied to the first shift register unit 40A is indicated by letters 'DYa', and the transmission start pulse DY supplied to the second shift register unit 40B is indicated by letters 'DYb'.

For example, in the shift register unit circuit Ua0, when the clock signal YCKa is at an H level, the clocked inverter CI01 inverts the transmission start pulse DYa and then outputs it. At that time, since the inversion clock signal YCKB turns to an L level, the output terminal of the clocked inverter CI02 turns to a high-impedance state. Therefore, in this case, the transmission start pulse DYa is output as a shift pulse C0*a* through the clocked inverter CI01 and the inverter I0*a*. Meanwhile, when the inversion clock signal YCKB is at an H level, the clocked inverter CI02 inverts a shift pulse C0 output from the inverter I0*a* and then outputs it to the inverter I0*a*. At that time, since the clock signal YCK turns to an L level, the output terminal of the clocked inverter CI01 turns to a high-impedance state. Therefore, in this case, a latch circuit is constituted by the clocked inverter CI02 and the inverter I0*a*.

In this way, the respective shift register unit circuits Ua0 to Uan sequentially shift the transmission start pulse DYa in synchronism with the clock signal YCKa and the inversion clock signal YCKBa to generate shift pulses C0*a* to Cna. As shown in FIG. 6, this shift operation causes the active periods (H levels) of a shift pulse and the next shift pulse to overlap each other by half the period of the clock signal YCKa.

The first signal generating unit 41A includes n NAND circuits NDa1 to NDan provided corresponding to the shift register unit circuits Ua0 to Uan, respectively. The NAND circuits NDa1 to NDan input the shift pulses from the corresponding shift register unit circuits and the shift pulses from the shift register unit circuits of the next stage. Then, the NAND circuits NDa1 to NDan each calculates the inversion of the logical product of the shift pulses and then outputs them as signals S1*a* to Sna. As shown in FIG. 6, for example, the NAND circuit NDa1 inverts the logical product of the shift pulse C0*a* from the first shift register unit circuit Ua0 and the shift pulse C1*a* of the second shift register unit circuit Ua1 to generate the signal S1*a*. The NAND circuits NDa1 to NDan function to generate signals which are in an active state in periods other than the period from a point of time when the shift pulse from the shift register unit circuit is in an active state to a point of time when the shift pulse of the shift register unit circuit of the next stage is in an active state.

In addition, n first level shifters 42A are provided corresponding to the shift register unit circuits Ua0 to Uan. The first level shifters 42A include amplifying circuits Ap1 to Apn and inverters Iv1 to Ivn. The signals S1*a* to Sna output from the first signal generating unit 41A are input to the amplifying circuits Ap1 to Apn through the corresponding inverters Iv1 to Ivn, respectively. The amplifying circuits Ap1 to Apn raise the voltage levels of the input signals S1*a* to Sna to the levels corresponding to driving power for driving the logic elements constituting the first output control circuit 43A of the next stage. Therefore, the voltage levels of the clock signal YCKa, the inversion clock signal YCKBa, and various signals of the first shift register unit 40A and the first signal generating unit 41A become low. As a result, it is possible to prevent an increase in the total power consumption of the electro-optical panel 21.

In this embodiment, the first output control circuit 43A is composed of n two-input NOR circuits Na1 to Nan. A low power supply voltage VLL is supplied to one input terminal of the first NOR circuit Na1 of the NOR circuits Na1 to Nan. In addition, the signal S1*a* is supplied to the other input terminal of the first NOR circuit Na1 through the first level shifter 42A. The first NOR circuit Na1 calculates the logical product of the low power supply voltage VLL and the signal S1*a* to generate an output signal SR1*a*. Therefore, when an L-level (Vll-level) signal S1*a* supplied through the first level shifter 42A is input, the first NOR circuit Na1 generates an H-level signal SR1*a*. In addition, when an H-level (Vhh-level) signal S1*a* supplied through the first level shifter 42A is input, the first NOR circuit Na1 generates an L-level output signal SR1*a*.

Further, the signals S2*a* to Sna whose levels are shifted up by the first level shifter 42A are input to the other input terminals of the second to n-th NOR circuits Na2 to Nan, respectively. The other input terminals are connected to the scanning lines in the previous stage (that is, one of the even-numbered scanning lines Y2, Y4, Y6, and the like) to be supplied with the scanning signals G2, G4, G6, and the like output from the second scanning line driving circuit 33B. The NOR circuits Na2 to Nan calculate the logical products of the signals S2*a* to Sna supplied through the first level shifter 42A and the scanning signals G2, G4, G6, and the like from the second scanning line driving circuit 33B connected to the scanning line in the previous stage to generate the corresponding output signals SR2*a* to SRna, respectively. For example, the second NOR circuit Na2 calculates the logical product of the signal S2*a* and the scanning signal G2 supplied to the even-numbered scanning line Y2 in the previous stage from the second scanning line driving circuit 33B to generate the output signal SR2*a*.

The first output buffer unit 44A is constituted by connecting two inverters r1 and r2 in series corresponding to the first to n-th NOR circuits Na1 to Nan. The output signals SR1 to SRn are respectively delayed by the two inverters r1 and r2 and are then output to the corresponding odd-numbered scanning lines Y1, Y3, Y5, and the like as the scanning signals G1, G3, G5, and the like. The first output buffer unit 44A outputs the output signals SR1 to SRn through the inverters r1 and r2, so that the output timing of the scanning signals G1, G3, G5, and the like are controlled.

In this way, the scanning signals G3, G5, and the like output to the odd-numbered scanning lines Y3, Y5, and the like are given as the logical products of the signals S2*n* to Sna, synchronized with the clock signal YCKa and the inversion clock signal YCKBa, and the scanning signals G2, G4, and the like output to the scanning lines Y2, Y4, and the like in the previous stage (even-numbered scanning lines). Therefore, at the end portions of the even-numbered scanning lines Y2, Y4, and the like (that is, in the portions positioned in the vicinity of the first scanning line driving circuit 33A), the even-numbered scanning signals G2, G4, and the like transmitted through the pixel forming region R have large time constants. For example, as shown in FIG. 6, a scanning signal G2 end at an end portion of the second scanning line Y2 has a large time constant, and thus the waveform thereof is deformed and delayed.

In this case, the first scanning line driving circuit 33A does not immediately generate the odd-numbered scanning signal G3 in response to the timing of the transmission start pulse DY (DYa), but generates the scanning signal G3 on the basis of the logical product of the signal S2*a* and the scanning signal G2 end having a large time constant. Therefore, as shown in FIG. 6, the period in which the scanning signal G3 is in an on state does not overlap the period in which the scanning signal G2 in the previous stage is in an on state.

That is, the first scanning line driving circuit 33A generates the scanning signals G3, G5, and the like to be supplied to the odd-numbered scanning lines Y3, Y5, and the like by using the transmission delay of the scanning signals G2, G4, and the like output to the even-numbered scanning lines Y2, Y4, and the like in the previous stage. As a result, as shown in FIG. 6, the periods in which the scanning signals G3, G5, and the like are in on states do not overlap the periods in which the scanning signals G2, G4, and the like in the previous stage are in on states.

Meanwhile, the second scanning line driving circuit 33B includes a second shift register unit 40B, a second signal generating unit 41B, a second level shifter 42B, a second output control circuit 43B, and a second output buffer unit 44B, similar to the first scanning line driving circuit 33A.

In the second scanning line driving circuit 33B, signals S1*b* to Snb whose levels are shifted up by the second level shifter 42B are input to one input terminal of each of NOR circuits N1*b* to Nnb constituting the second output control circuit 43B, respectively. The other input terminals are connected to the scanning lines in the previous stage (that is, one of the odd-numbered scanning lines Y1, Y3, and the like) to be supplied with the scanning signals output from the first scanning line driving circuit 33A. The NOR circuits N1*b* to Nnb calculate the logical products of the signals S1*b* to Snb supplied through the second level shifter 42B and the scanning signals G1, G3, G5, and the like output from the first scanning line driving circuit 33A connected to the scanning lines in the previous stage to generate the corresponding output signals SR1*b* to SRnb, respectively. In addition, the second output buffer unit 44B delays the output signals SR1*b* to SRnb to output the delayed signals to the corresponding even-numbered scanning lines Y2, Y4, and the like as the scanning signals G2, G4, and the like.

In this way, the even-numbered scanning signals G2, G4, and the like in the next stage are not immediately output in response to the timing of the transmission start pulse DY (DYb), but are generated on the basis of the scanning signals G1, G3, G5, and the like having large time constants. That is, the second scanning line driving circuit 33B generates the scanning signals G2, G4, and the like to be output to the even-numbered scanning lines Y2, Y4, and the like by using the transmission delay of the scanning signals G1, G3, G5, and the like output to the odd-numbered scanning lines Y1, Y3, Y5, and the like in the previous stage. As a result, as shown in FIG. 6, the periods in which the scanning signals G2, G4, and the like are in on states do not overlap the periods in which the scanning signals G1, G3, G5, and the like in the previous stage are in on states.

The first output signals described in the appended claims correspond to, for example, the shift pulses Ca0 to Can in this embodiment. The second output signals described in the appended claims correspond to, for example, the shift pulses Cb0 to Cbn in this embodiment. The start pulse described in the appended claims corresponds to, for example, the transmission start pulse DY in this embodiment. The first scanning signals described in the appended claims correspond to, for example, the odd-numbered scanning signals G1, G3, and the like in this embodiment. The second scanning signals described in the appended claims correspond to, for example, the even-numbered scanning signals G2, G4, and the like in this embodiment.

Further, the first shift unit circuits described in the appended claims correspond to, for example, the shift register unit circuits Ua0 to Uan in this embodiment. The second shift unit circuits described in the appended claims correspond to, for example, the shift register unit circuits Ub0 to Ubn in this embodiment.

As described above, this embodiment has the following effects:

(1) According to this embodiment, the first scanning line driving circuit 33A and the second scanning line driving circuit 33B are provided opposite to each other with the pixel forming region R interposed therebetween. The odd-numbered scanning lines Y1, Y3, and the like are connected to the first sequential transmission circuit 34A of the first scanning line driving circuit 33A, and the even-numbered scanning lines Y2, Y4, . . . , Y2*n* are connected to the second sequential transmission circuit 34B of the second scanning line driving circuit 33B. In addition, the scanning lines Y1 to Y2*n* are connected to the first and second output control circuit units 35A and 35B of the first and second scanning line driving circuits 33A and 33B. The first output control circuit unit 35A calculates the logical products of the shift pulses output from the first sequential transmission circuit 34A and the scanning signals G2, G4, . . . , G2*n* from the scanning lines Y2, Y4, . . . , Y2*n* to generate the odd-numbered scanning signals G1, G3, and the like, and then outputs the signals to the corresponding odd-numbered scanning lines Y1, Y3, and the like. In addition, the second output control circuit unit 35B inputs the scanning signals G1, G3, and the like through the odd-numbered scanning lines Y1, Y3, and the like. Then, the second output control circuit unit 35B calculates the logical products of the shift pulses output from the second sequential transmission circuit 34B and the scanning signals G1, G3, and the like from the scanning lines Y1, Y3, and the like to generate the even-numbered scanning signals G2, G4, and the like, and then output the signals to the corresponding even-numbered scanning lines Y2, Y4, and the like.

Therefore, the periods in which the scanning signals G1, G3, and the like to be output to the odd-numbered scanning lines Y1, Y3, and the like are in on states do not overlap the periods in which the scanning signals G2, G4, and the like output to the even-numbered scanning lines Y2, Y4, and the like are in on states. As a result, the pixels 25 corresponding to the odd-numbered scanning lines Y1, Y3, and the like are not simultaneously turned on with the pixels 25 corresponding to the even-numbered scanning lines Y2, Y4, . . . , Y2*n*. Thus, it is possible to reliably prevent a plurality of scanning lines from being selected at the same time. As a result, the same image signal is not output to different scanning lines, and thus abnormal display, such as a longitudinal ghost image (or 'cross-talk'), does not occur.

(2) According to this embodiment, the first scanning line driving circuit 33A and the second scanning line driving circuit 33B are provided opposite to each other with the pixel forming region R interposed therebetween. In addition, among 2n scanning lines Y1 to Y2*n*, the odd-numbered scanning lines Y1, Y3, and the like are connected to the first scanning line driving circuit 33A, and the even-numbered scanning lines Y2, Y4, . . . , Y2*n* are connected to the second scanning line driving circuit 33B. Therefore, it is possible to reduce the circuit size of each scanning line driving circuit, compared with a case in which a scanning line driving circuit is provided on only one side.

(3) According to this embodiment, the first scanning line driving circuit 33A and the second scanning line driving circuit 33B are provided opposite to each other with the pixel forming region R interposed therebetween. In addition, among the 2n scanning lines Y1 to Y2*n*, the odd-numbered scanning lines Y1, Y3, and the like are connected to the first scanning line driving circuit 33A, and the even-numbered scanning lines Y2, Y4, . . . , Y2*n* are connected to the second scanning line driving circuit 33B. Therefore, it is possible to widen wiring pitches between the scanning lines Y1 to Y2*n* from the output buffer units 44A and 44B, compared with a case in which a scanning line driving circuit is provided on only one side. As a result, it is possible to easily design a scanning line driving circuit.

(4) According to this embodiment, the first and second output control circuits 43A and 43B are composed of the NOR circuits Na1 to Nan and Nb1 to Nbn, respectively. Therefore, it is possible to easily control the waveforms of the generated scanning signals G1 to G2*n*.

(5) According to this embodiment, the first output control circuit 43A is provided between the first shift register unit 40A and the first output buffer unit 44A. In addition, the second output control circuit 43B is provided between the second shift register unit 40B and the second output buffer unit 44B. Therefore, the first level shifter 42A for controlling the levels of the signals output from the first and second shift register units 40A and 40B can be provided between the output control circuits 43A and 43B and the first and second shift register units 40A and 40B. As a result, various signals of the first shift register unit 40A and the first signal generating unit 41A, or the clock signal YCKa and the inversion clock signals YCKBa may have low voltage levels. As a result, it is possible to prevent an increase in the total power consumption of the electro-optical panel 21.

Second Embodiment

Next, a second embodiment of the invention will be described with reference to FIG. 7. In the second embodiment, the same components as those in the first embodiment have the same reference numerals, and a description thereof will be omitted.

Figure 7:
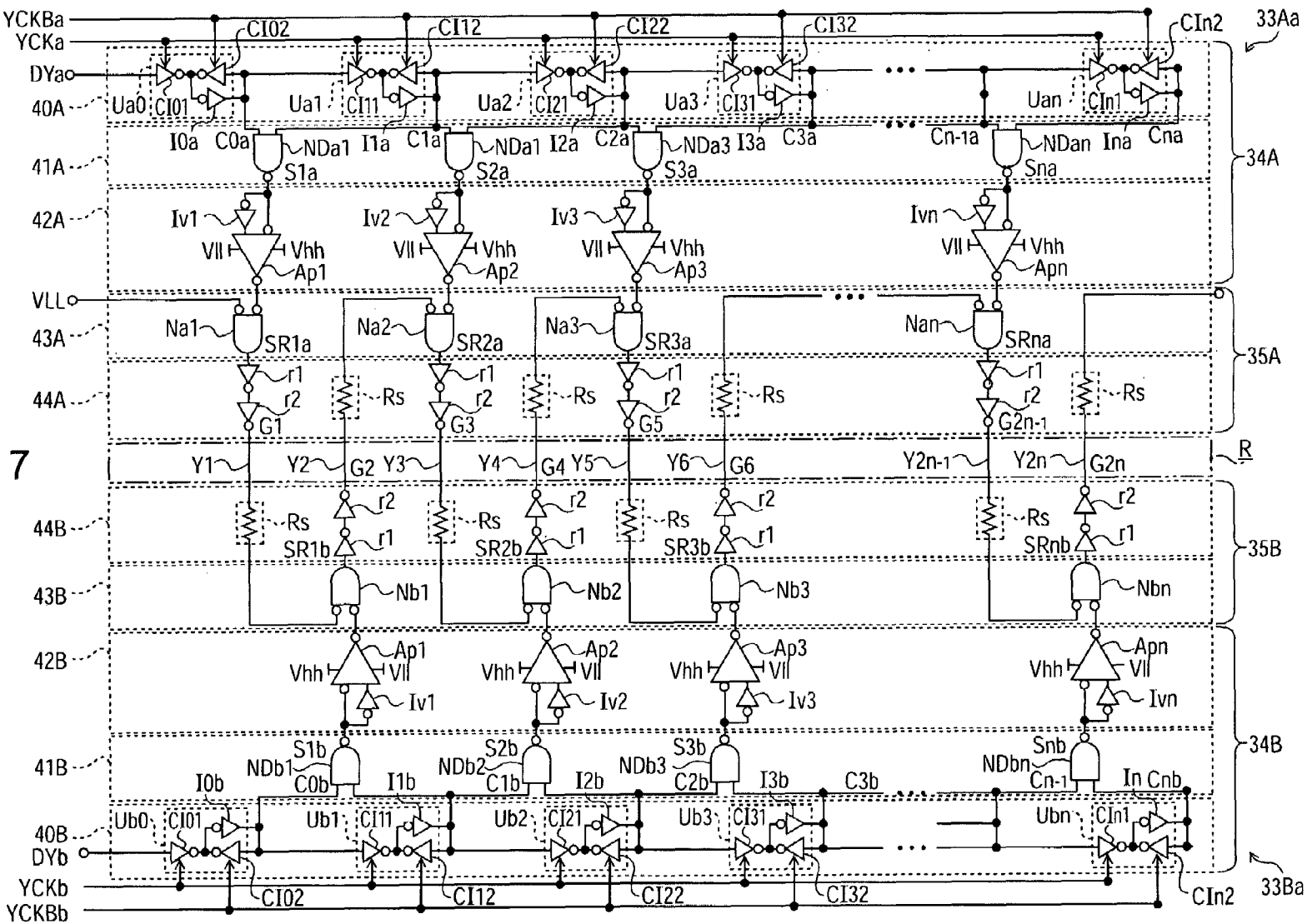
FIG. 7 is a view illustrating a first scanning line driving circuit and a second scanning line driving circuit according to a second embodiment.

FIG. 7 is a circuit diagram illustrating a first scanning line driving circuit 33Aa and a second scanning line driving circuit 33Ba according to the second embodiment in detail.

As shown in FIG. 7, a first output control circuit 43A of the first scanning line driving circuit 33Aa and a second output control circuit 43B of the second scanning line driving circuit 33Ba are respective provided with resistors Rs, serving as delay circuits, interposed between the scanning lines Y1 to Y2*n* and the NOR circuits Na1 to Nan and Nb1 to Nbn. Thus, the scanning signals G1 to G2*n* are input to the corresponding NOR circuits Na1 to Nan and Nb1 to Nbn through the resistors Rs, respectively.

Therefore, the selected scanning signals G1 to G2*n* in the current stage are further delayed and are then transmitted. As a result, the period in which the scanning signals in the current stage overlap the scanning signals in the next stage is reliably removed, compared with the electro-optical device 10 of the first embodiment.

Third Embodiment

Next, a third embodiment of the invention will be described with reference to FIG. 8. In the third embodiment, the same components as those in the first embodiment have the same reference numerals, and a description thereof will be omitted.

Figure 8:
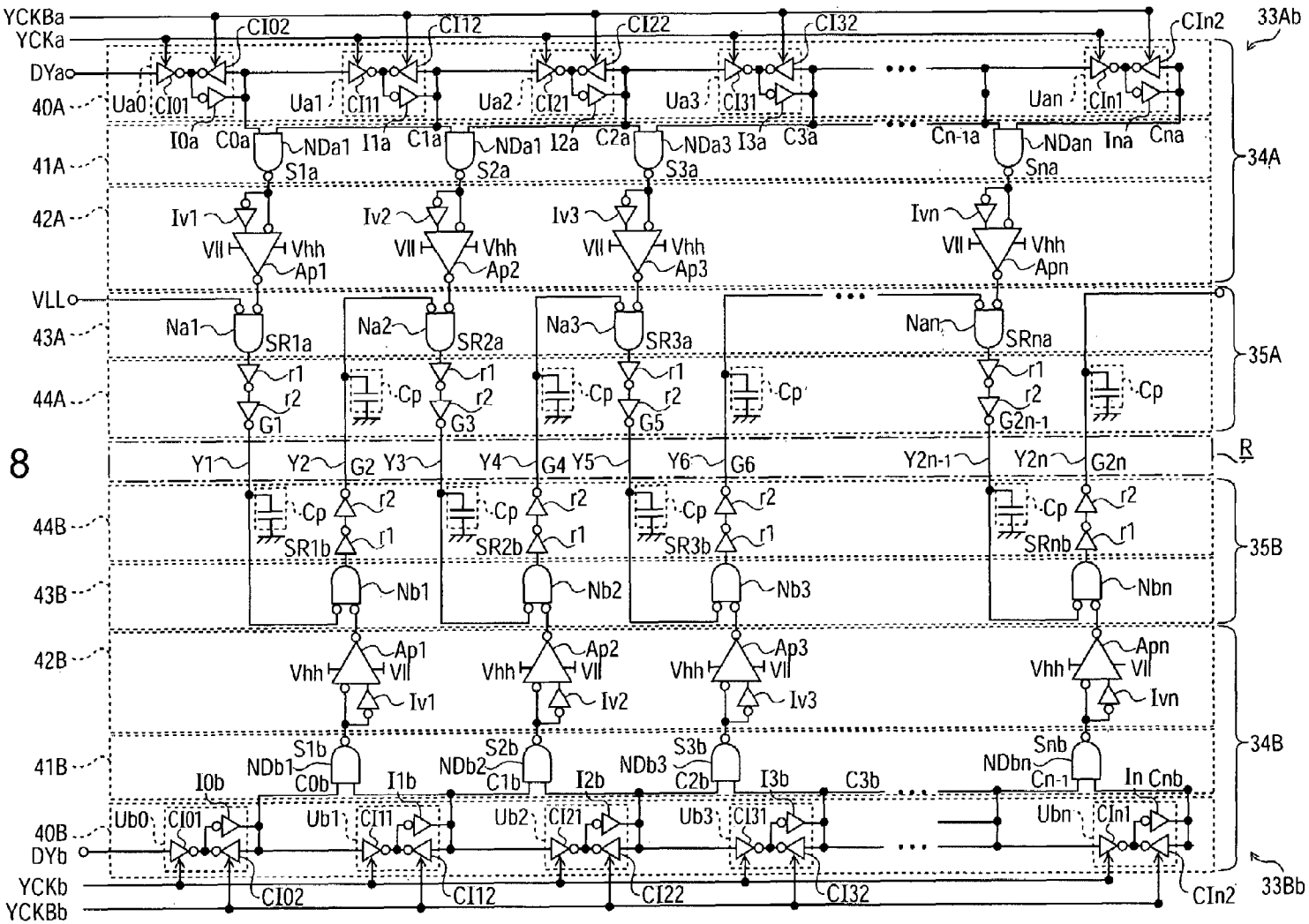
FIG. 8 is a view illustrating a first scanning line driving circuit and a second scanning line driving circuit according to a third embodiment.

FIG. 8 is a circuit diagram illustrating a first scanning line driving circuit 33Ab and a second scanning line driving circuit 33Bb according to the third embodiment in detail.

As shown in FIG. 8, a first output control circuit 43A of the first scanning line driving circuit 33Ab and a second output control circuit 43B of the second scanning line driving circuit 33Bb are respective provided with capacitors Cp, serving as delay circuits, interposed between the scanning lines Y1 to Y2*n* and the NOR circuits Na1 to Nan and Nb1 to Nbn. Thus, the scanning signals G1 to G2*n* are input to the corresponding NOR circuits Na1 to Nan and Nb1 to Nbn through the capacitors Cp, respectively.

Therefore, the selected scanning signals G1 to G2*n* in the current stage are further delayed and are then transmitted. As a result, the period in which the scanning signals in the current stage overlap the scanning signals in the next stage is reliably removed, compared with the electro-optical device 10 of the first embodiment.

Fourth Embodiment

Next, an electronic apparatus including the electro-optical device according to the first to third embodiments will be described with reference to FIG. 9. The electro-optical device 10 can be applied to various electronic apparatuses, such as a portable personal computer, a cellular phone, and a digital camera.

Figure 9:
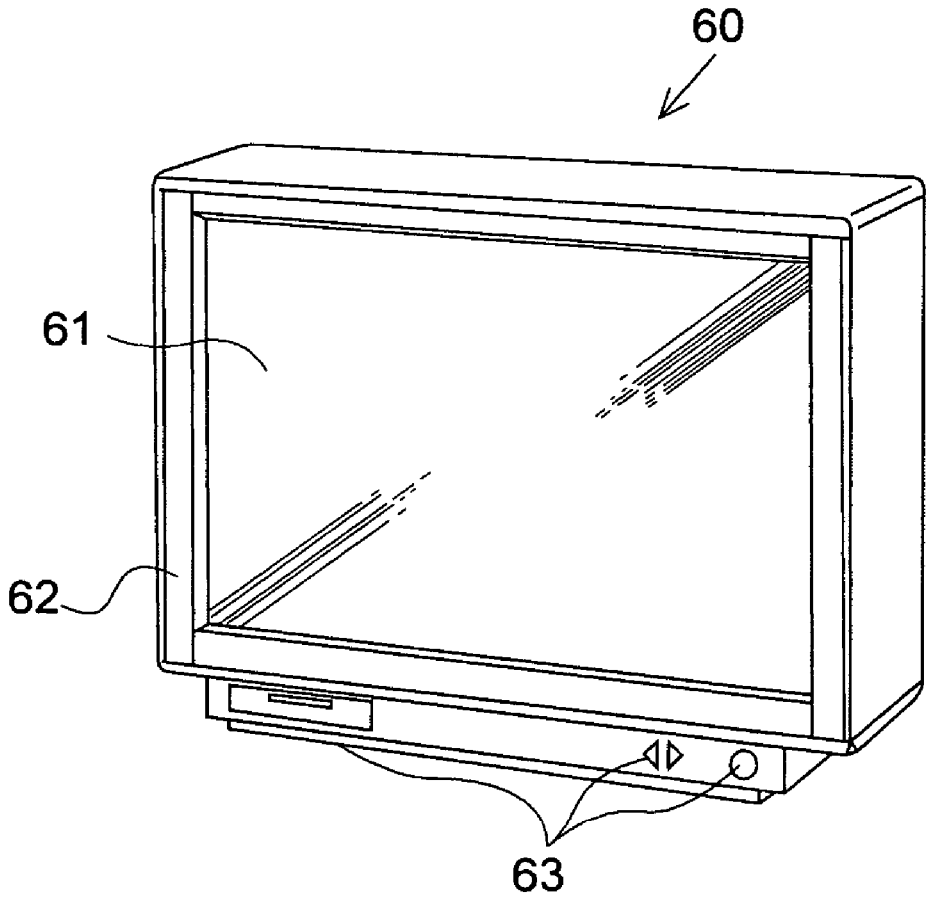
FIG. 9 is a perspective view illustrating a large television as an electronic apparatus according to a fourth embodiment.

FIG. 9 is a perspective view illustrating a large television 60. The large television 60 includes a display unit 61 for a large television, provided with the electro-optical device 10, speakers 62, and a plurality of operating buttons 63. In this case, since a plurality of scanning lines Y1 to Y2*n* are not selected at the same time, abnormal display, such as a longitudinal ghost image (cross-talk), does not occur in the display unit 61. As a result, it is possible to realize an electronic apparatus capable of display high-quality images.

Further, the invention is not limited to the above-described embodiments, but the following modifications can be made.

In the above-described embodiments, the first output control circuit 43A is provided between the first shift register unit 40A and the first output buffer unit 44A. The second output control circuit 43B is provided between the second shift register unit 40B and the second output buffer unit 44B. In addition, the first level shifter 42A for controlling the levels of the signals output from the first and second shift register units 40A and 40B is provided between the output control circuits 43A and 43B and the first and second shift register units 40A and 40B. However, the invention is not limited thereto, but the first and second shift register units 40A and 40B may not be provided.

What is claimed is:

1. An electro-optical device comprising:

an electro-optical panel that includes a plurality of scanning lines, a plurality of data lines, and pixels provided corresponding to intersections of the scanning lines and the data lines;

a first scanning line driving circuit that outputs first scanning signals to odd-numbered scanning lines of the plurality of scanning lines; and a second scanning line driving circuit that outputs second scanning signals to even-numbered scanning lines of the plurality of scanning lines, the second scanning line driving circuit being opposite to the first scanning line driving circuit with a pixel forming region having the pixels formed therein interposed therebetween, wherein the first scanning line driving circuit includes:

a first shift register unit that is constituted by cascading a plurality of first shift unit circuits which sequentially shift a start pulse, on the basis of a clock signal, to output first output signals;

a first output control circuit that has a plurality of first calculation unit circuits which are provided corresponding to the first shift unit circuits, the first calculation unit circuits calculating the logical products of the first output signals and the second scanning signals output through the corresponding even-numbered scanning lines from the second scanning line driving circuit to generate the first scanning signals; and a first output buffer unit that is connected to the odd-numbered scanning lines to output the first scanning signals to the corresponding odd-numbered scanning lines, and the second scanning line driving circuit includes:

a second shift register unit that is constituted by cascading a plurality of second shift unit circuits which sequentially shift the start pulse, on the basis of the clock signal, to output second output signals;

a second output control circuit that has a plurality of second calculation unit circuits which are provided corresponding to the second shift unit circuits, the second calculation unit circuits calculating the logical products of the second output signals and the first scanning signals output through the corresponding odd-numbered scanning lines from the first scanning line driving circuit to generate the second scanning signals; and a second output buffer unit that is connected to the even-numbered scanning lines to output the second scanning signals to the corresponding even-numbered scanning lines, wherein the first output control circuit is provided between the first shift register unit and the first output buffer unit, and the second output control circuit is provided between the second shift register unit and the second output buffer unit.

2. The electro-optical device according to claim 1, wherein the first and second calculation unit circuits are composed of one of NAND circuits and NOR circuits, respectively.

3. The electro-optical device according to claim 1, wherein the electro-optical panel further includes resistors that are respectively provided between the first output control circuit and the first scanning lines and between the second output control circuit and the second scanning lines.

4. The electro-optical device according to claim 1, wherein the electro-optical panel further includes capacitors that are provided between the first output control circuit and the first scanning lines and between the second output control circuit and the second scanning lines.

5. An electronic apparatus comprising the electro-optical device according to claim 1.

6. An electro-optical device comprising:

an electro-optical panel that includes a plurality of scanning lines, a plurality of data lines, and pixels provided corresponding to intersections of the scanning lines and the data lines;

a first scanning line driving circuit that outputs first scanning signals to odd-numbered scanning lines of the plurality of scanning lines; and a second scanning line driving circuit that outputs second scanning signals to even-numbered scanning lines of the plurality of scanning lines, the second scanning line driving circuit being opposite to the first scanning line driving circuit with a pixel forming region having the pixels formed therein interposed therebetween, wherein the first scanning line driving circuit includes:

a first shift register unit that is constituted by cascading a plurality of first shift unit circuits which sequentially shift a start pulse, on the basis of a clock signal, to output first output signals;

a first output control circuit that has a plurality of first calculation unit circuits which are provided corresponding to the first shift unit circuits, the first calculation unit circuits calculating the logical products of the first output signals and the second scanning signals output through the corresponding even-numbered scanning lines from the second scanning line driving circuit to generate the first scanning signals; and a first output buffer unit that is connected to the odd-numbered scanning lines to output the first scanning signals to the corresponding odd-numbered scanning lines, and the second scanning line driving circuit includes:

a second shift register unit that is constituted by cascading a plurality of second shift unit circuits which sequentially shift the start pulse, on the basis of the clock signal, to output second output signals;

a second output control circuit that has a plurality of second calculation unit circuits which are provided corresponding to the second shift unit circuits, the second calculation unit circuits calculating the logical products of the second output signals and the first scanning signals output through the corresponding odd-numbered scanning lines from the first scanning line driving circuit to generate the second scanning signals; and a second output buffer unit that is connected to the even-numbered scanning lines to output the second scanning signals to the corresponding even-numbered scanning lines, wherein the electro-optical panel further includes delay circuits that are respectively provided between the first output control circuit and the first scanning lines and between the second output control circuit and the second scanning lines.

7. The electro-optical device according to claim 6, wherein the first and second calculation unit circuits are composed of one of NAND circuits and NOR circuits, respectively.

8. The electro-optical device according to claim 6, wherein the electro-optical panel further includes resistors that are respectively provided between the first output control circuit and the first scanning lines and between the second output control circuit and the second scanning lines.

9. The electro-optical device according to claim 6, wherein the electro-optical panel further includes capacitors that are provided between the first output control circuit and the first scanning lines and between the second output control circuit and the second scanning lines.

10. An electronic apparatus comprising the electro-optical device according to claim 6.

* * * * *